US008573406B2

(12) United States Patent
von Haas

(10) Patent No.: US 8,573,406 B2
(45) Date of Patent: Nov. 5, 2013

(54) SIEVING DEVICE AND METHOD FOR SORTING OUT FOREIGN PARTICLES AND A SYSTEM FOR THE PRODUCTION OF COMPOSITE WOOD BOARDS WITH SUCH A SIEVING DEVICE

(75) Inventor: Gernot von Haas, Heidelberg (DE)

(73) Assignee: Dieffenbacher GmbH Maschinen- und Anlagenbau, Eppingen (DE)

( * ) Notice: Subject to any disclaimer, the term of this patent is extended or adjusted under 35 U.S.C. 154(b) by 240 days.

(21) Appl. No.: 12/567,313

(22) Filed: Sep. 25, 2009

(65) Prior Publication Data

US 2010/0078132 A1 Apr. 1, 2010

(30) Foreign Application Priority Data

Sep. 28, 2008 (DE) ..... 10 2008 048 947

(51) Int. Cl.
*B07B 13/00* (2006.01)

(52) U.S. Cl.
USPC ..... 209/672; 209/671

(58) Field of Classification Search
USPC ..... 209/667–673
See application file for complete search history.

(56) References Cited

U.S. PATENT DOCUMENTS

| | | | | |
|---|---|---|---|---|
| 622,035 | A * | 3/1899 | Bray | 209/627 |
| 2,947,416 | A * | 8/1960 | Owen | 209/28 |
| 4,068,991 | A * | 1/1978 | Ufermann et al. | 425/81.1 |
| 4,452,694 | A * | 6/1984 | Christensen et al. | 209/672 |
| 4,871,073 | A * | 10/1989 | Berry et al. | 209/672 |
| 5,060,806 | A * | 10/1991 | Savage | 209/668 |
| 5,088,398 | A | 2/1992 | Bielfeldt | |
| 5,626,239 | A * | 5/1997 | Kobayashi | 209/667 |
| 5,740,922 | A * | 4/1998 | Williams | 209/668 |
| 6,149,018 | A * | 11/2000 | Austin et al. | 209/672 |
| 6,250,478 | B1 * | 6/2001 | Davis | 209/672 |
| 6,986,425 | B2 * | 1/2006 | Paladin | 209/671 |
| 2006/0180523 | A1 | 8/2006 | Smith | |
| 2006/0180524 | A1 * | 8/2006 | Duncan et al. | 209/672 |

FOREIGN PATENT DOCUMENTS

| | | |
|---|---|---|
| DE | 39 13 991 C2 | 10/1990 |
| EP | 1 007 227 B1 | 10/2002 |
| EP | 1 358 020 B1 | 4/2007 |

* cited by examiner

*Primary Examiner* — Joseph C Rodriguez
(74) *Attorney, Agent, or Firm* — Foley & Lardner LLP

(57) ABSTRACT

A device for sieving foreign bodies out of a material stream, wherein the device comprises a roller sieve comprising a plurality of rollers disposed in parallel to one another and discs disposed on the plurality of rollers such that they are perpendicular to the axial extension of the rollers, wherein the discs of adjacent rollers are engaged so as form slot areas between the discs and the adjacent rollers, and the discs comprise impulse discs for disaggregating a material stream disposed on the roller sieve, and conveyor discs for conveying the material stream in a transport direction and through the slot area. A corresponding process and an apparatus or system for the production of composite boards with such a device.

23 Claims, 6 Drawing Sheets

SIEVING DEVICE AND METHOD FOR SORTING OUT FOREIGN PARTICLES AND A SYSTEM FOR THE PRODUCTION OF COMPOSITE WOOD BOARDS WITH SUCH A SIEVING DEVICE

CROSS-REFERENCE TO RELATED PATENT APPLICATIONS

Germany Priority Application DE 10 2008 048 947.6, filed Sep. 28, 2008, including the specification, drawings, claims and abstract, is incorporated herein by reference in its entirety.

BACKGROUND

The invention relates to a device and method for sieving foreign bodies out of a material stream in the course of the production of oriented strand boards. Furthermore, the invention relates to an apparatus or system for the production of composite wood boards with such a device.

In the large-scale industrial production of composite wood boards continuously operating presses are used. In these presses, such as those described in DE 39 13 991 C2, the pressing force is transferred by hydraulic actuating elements onto the pressing or heating plates and further, via steel belts which are disposed so as to be supported via a bed of rolling bodies (roller rods) and so as to be endlessly revolving onto the material to be pressed. In the case of said transfer elements the steel belts with thicknesses of around 1.5 to 4 mm form, in comparison to the other, significantly stiffer elements, are the weakest component in the chain of machine elements and are prone to failure. In this connection this does not mean that the steel belt fails completely. Should the surface of the steel belt have defects, this already leads to an inadequate surface quality of the end product and thus to rejection. In the production of ever thinner, and above all highly compacted, composite wood boards the deformation work to be applied increases so sharply with partial differences in the density of the material to be pressed that even variations in density that have a very small surface area, e. g., lumps of adhesive in the material to be pressed, can lead to pressure marks on the surface of the steel belt or even to destruction of the steel belt. For the large-surface hydraulic cylinders in use in the main press area such partial variations in pressure lie outside of the measurable area, in particular since still more machine elements are disposed between the steel belt and the hydraulic cylinder. Thus it is not possible to recognize and, if necessary, correct denting of the steel belts which arises via measuring devices on the large hydraulic cylinders.

In the course of the development of the technology there has been in recent years increasing research, and poor results, in the use of detection systems for determining elevations in density in order to remove lumps of adhesive or similar foreign bodies of harmful size from a spread mat of material to be pressed before it is pressed. Usually this happens by ejecting the corresponding portion of the mat from the forming belt into a discard hopper. Since, however, the recovery of poorly spread pressed material mat or trial spreadings is the usual task of the discard hopper, it can happen that detected foreign bodies get into the production cycle once again since a complete sieving of all the material out of the discard hopper once again is very expensive.

Basically there is at present no technological solution for production systems which make it possible, at an acceptable cost, to filter the lumps of adhesive greater than 15 mm in diameter out of a material stream consisting of flakes to which adhesive has just been applied. Traditional sieve systems are not suitable for this purpose since they provide the necessary minimum throughput per hour only with large-scale sieve systems which are expensive to procure and to maintain. Also these sieve systems, which usually screen in such a manner that thinner or smaller material falls through the sieve and larger material is discharged at the end, have the disadvantage that lumps of adhesive can "hide" in the larger material and continue to remain in the material stream.

SUMMARY

The invention is based on the object of providing a device, a method, and an apparatus for the production of composite boards which avoid the pressing of lumps of adhesive of larger diameter in a press from the beginning and, after the device for applying adhesive, can filter out, with high reliability, foreign bodies which are harmful to the system and are of a predefined size and in so doing particularly lumps of adhesive from the process of applying adhesive to the material. Furthermore, a high material throughput per unit of time with little available space should be possible.

A realization of this object for a device lies in the fact that on each roller of a roller sieve there are disposed, with a predefined spacing, impulse discs for disaggregating the material stream on the roller sieve and conveyor discs for conveying the material stream in the transport direction and through the slot area.

A realization of the object for a device lies in the fact that the flakes of the material stream are conveyed by the conveyor discs and are aligned in two planes by the partially disposed larger impulse discs, specifically the longitudinal and horizontal extension of the flakes are aligned so as to be approximately parallel to the plane of the conveyor discs or impulse discs so that with their smallest dimension, their thickness, they can fall through the slot area while foreign bodies, such as lumps of adhesive or oversize flakes, are conveyed up to the end of the roller sieve and thus are separated out of the production process.

A proposed realization for an apparatus lies in the fact that after the device for applying adhesive there is disposed a device for sieving foreign bodies out of a material stream consisting of flakes to which adhesive has been applied. In so doing, a device is preferably disposed which sends the material stream through a roller sieve and only separates out foreign bodies of a certain size or lumps of adhesive.

Basically the method and the device can be operated independently of one another but the device is also particularly suitable for carrying out the process.

Lumps of adhesive or other foreign bodies, specifically those of a predefined diameter or extent in all three dimensions (length, width, thickness), are removed from a material stream, containing in particular flakes to which adhesive has been freshly applied. In so doing, the complete material stream is passed through a roller sieve in which foreign bodies or lumps of adhesive are reliably held back and thus can be removed from the production process. Due to the simplicity of the device or the method it is ensured that a high reliability of production and low downtimes can be achieved.

Additional advantageous measures and development of the subject of the invention follow from the following description with the drawings.

DETAILED DESCRIPTION

Figure 1:
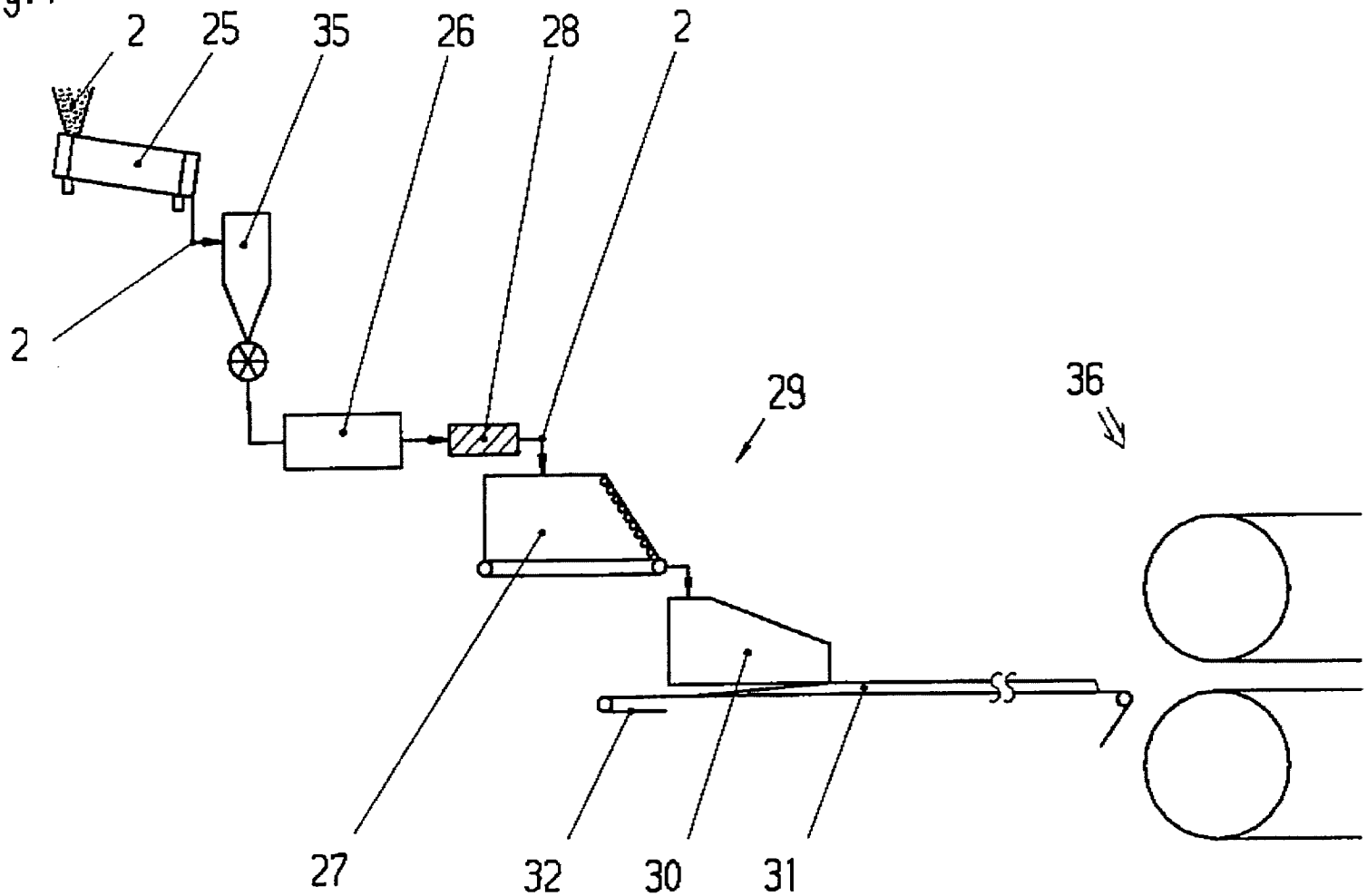
FIG. 1 shows a schematic representation of an apparatus and of the production process according to the state of the art from the drying of the flakes up to the pressing of a spread mat in a press.
Figure 9:
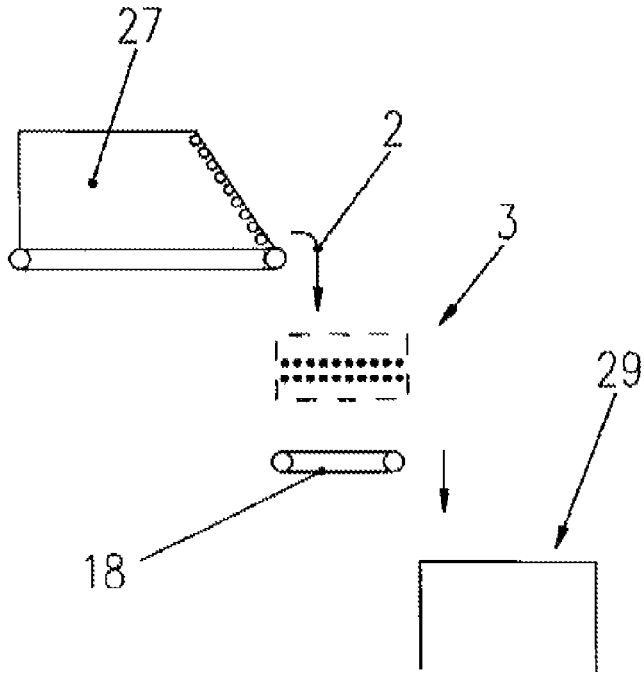
FIG. 9 shows a first example of the possible arrangement of a device according to the invention in an apparatus between a dosing hopper and spreading device.
Figure 10:
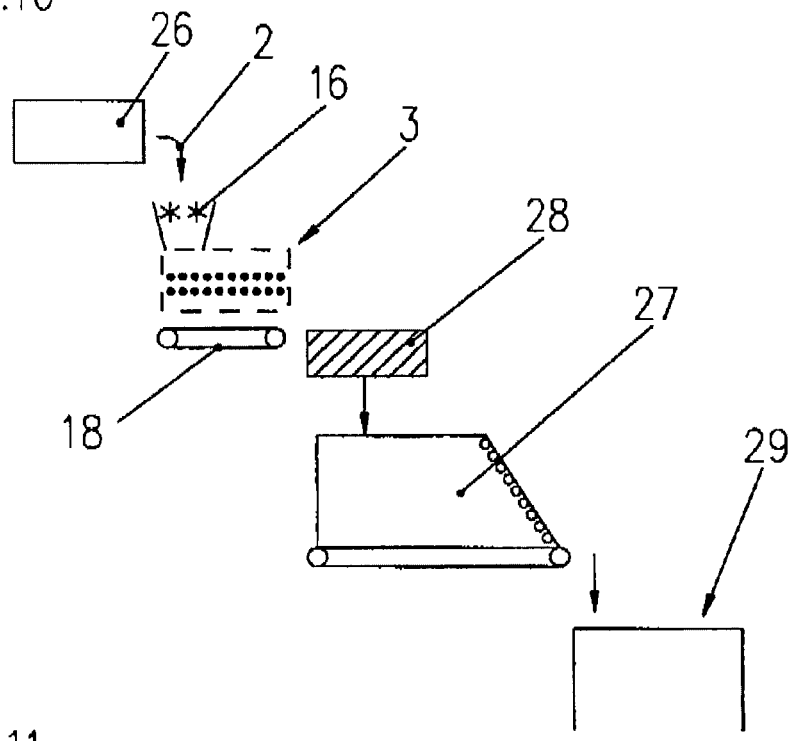
FIG. 10 shows a second example of the possible arrangement of a device according to the invention in an apparatus between a device for applying adhesive and a feed device for a flake hopper.
Figure 11:
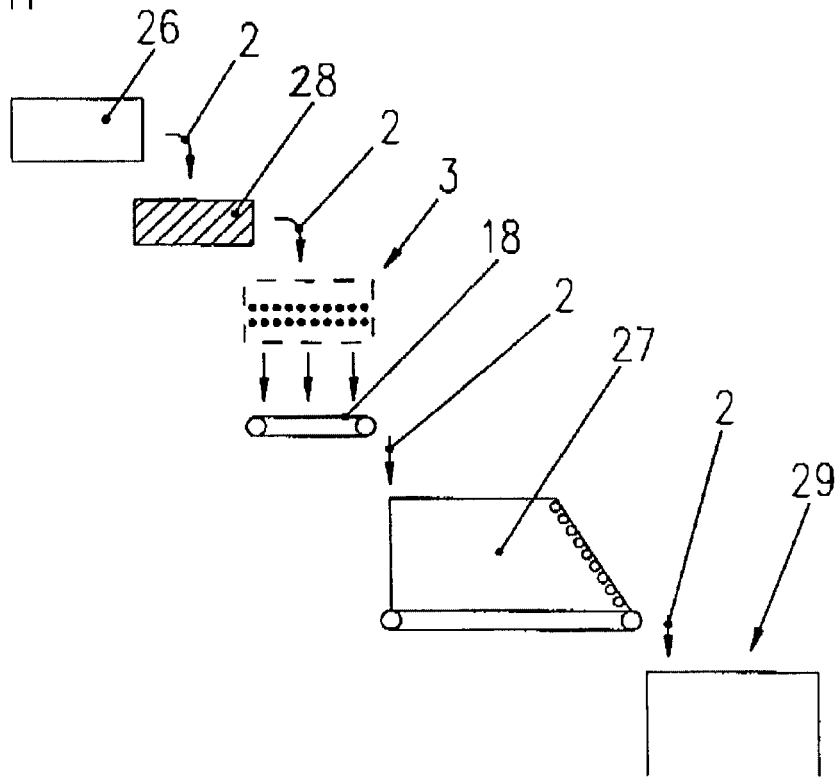
FIG. 11 shows a third example of the possible arrangement of a device according to the invention in an apparatus between a feed device and a flake hopper.

In FIG. 1, a schematic representation of an apparatus and of the production process according to the state of the art is shown from the drying of the flakes up to the pressing of a spread mat 31 in a press 36. Therein a material stream 2 consisting of flakes which are suitable for the manufacture of an oriented strand board (OSB) is input into a drying device 25, separated by means of a cyclone 35 from fine dust and the drying air, and, after a sluice, conveyed into a device 26 for applying adhesive. Following that, the material stream 2 is fed by means of a feed device 28, e. g., a slewing screw conveyor, into the flake hopper 27. Following that, the material stream 2 is delivered in doses to the spreading device 29 and spread with the corresponding spreading head 30 to form a mat 31 on a forming belt 32 and further on in the processing pressed with a press 36. In the scope of the invention it is proposed, in an apparatus of this type, to dispose a device 3, with respect to the course of production, after the device 26 for applying adhesive. As represented in FIGS. 9 to 11 the device 3 will be disposed in a preferred arrangement before or after the feed device 28 for the flake hopper 27 (FIGS. 10, 11). As the feed device 28 for the flake hopper 27, a slewing screw conveyor (not represented in detail) is preferably disposed. In an arrangement of the device 3 after the slewing screw conveyor, a roller sieve 5 of the device 3 is implemented and disposed in such a manner that it can traverse and it slews with the slewing screw conveyor (FIG. 11). In a further preferred example, the device 3 is disposed between the flake hopper 27 and spreading device 28 with a spreading head 30 (FIG. 9).

In FIGS. 2 to 8 the device 3 for sieving foreign bodies 1 out of a material stream 2 is represented in its details. Therein the device 3 when active is basically defined by a roller sieve 5 bounded by a guide plate 37 and comprising several rollers 4 disposed in parallel to one another, where, on the rollers 4 and perpendicular to their axial extension, impulse discs 7 and conveyor discs 8 are disposed which engage completely or partly meshing with the impulse discs 7 and conveyor discs 8 of the adjacent rollers 4 and thus form a slot area 6 between the rollers 4. Particularly important for the effect is the fact that on each roller 4 there are disposed, with a predefined spacing, impulse discs 7 for disaggregating the material stream 2 on the roller sieve 5 and conveyor discs 8 to convey the material stream 2 in the transport direction 9 and through the slot area 6. In a preferred form, the impulse discs 7 are disposed in the roller sieve 5 in such a manner that per slot area 6 only one impulse disc 7 is disposed at the boundaries. The slot area 6 is therefore defined by four discs, two shafts, and their axles. It is furthermore advantageous if on one roller 4 at least three conveyor discs 8 are disposed between two impulse discs 7. There is thus enough clearance for the flakes, if they are set up in the vertical plane by the impulse discs 7, for them to fall through between the several conveyor discs 8. In particular, this can be promoted if on a roller 4 the adjacent conveyor discs 8, 8', 8" have different diameters 15, 15', 15".

Figure 3:
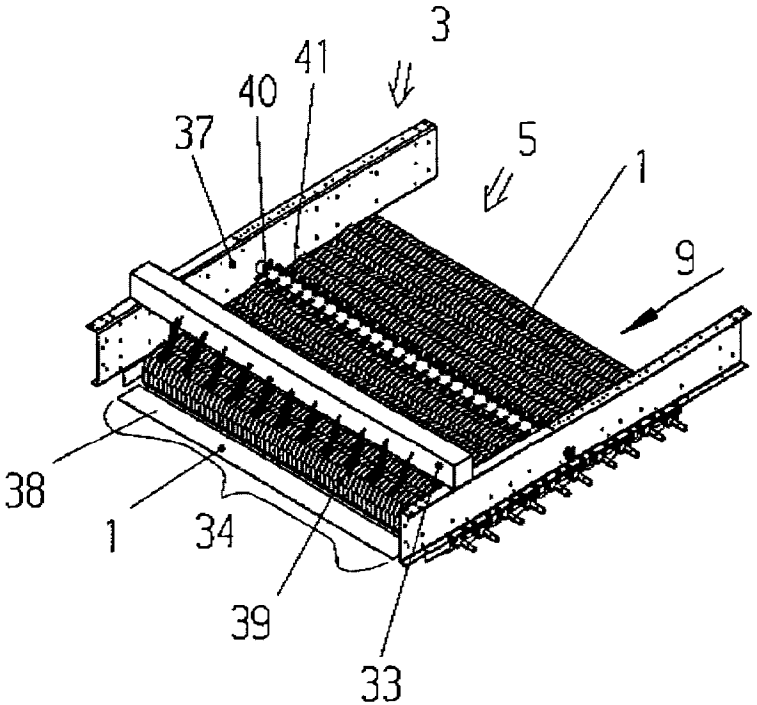
FIG. 3 shows a perspective view of the device according to FIG. 2.
Figure 2:
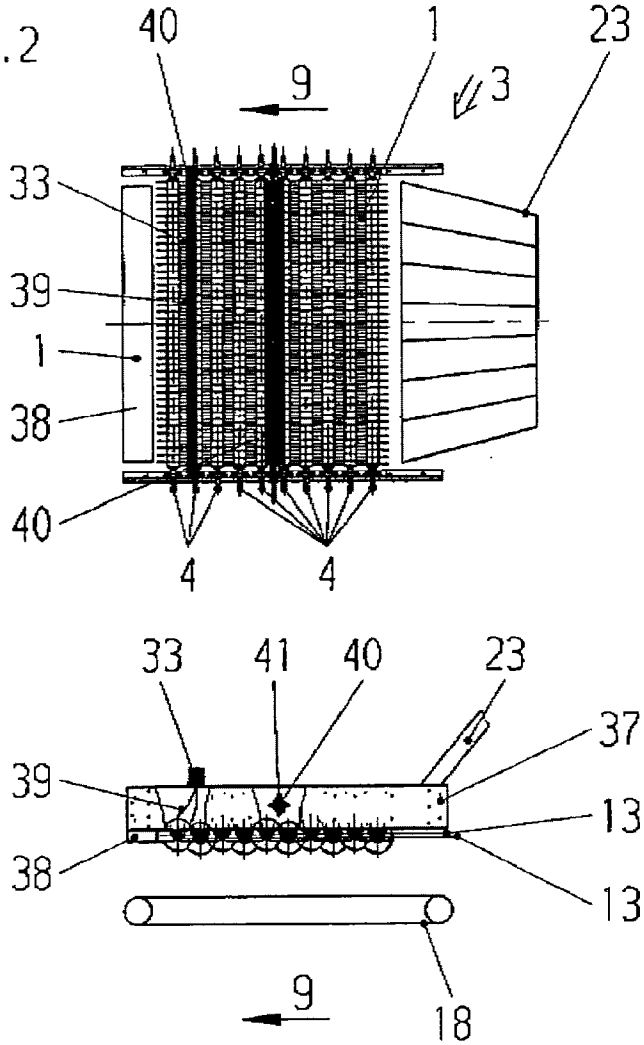
FIG. 2 shows a schematic top view of a device according to the invention with a roller sieve with a corresponding side view.
Figure 4:
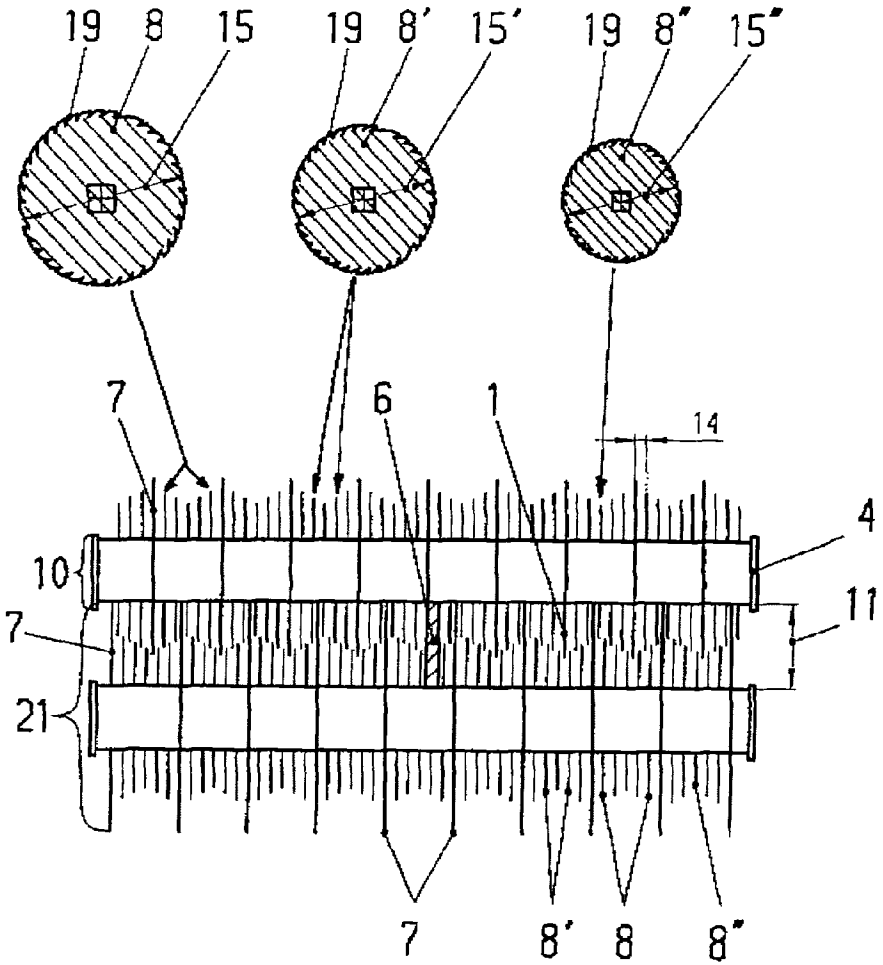
FIG. 4 shows an overview of sections of the different discs of a roller of the roller sieve.
Figure 4:
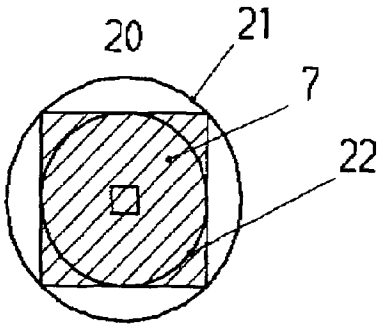

In FIGS. 2 and 3 there are represented, above the roller sieve 5, retaining means which can be disposed, preferably in the further course of the roller sieve 5 in the transport direction 9. They are, for example, a retaining plate (not represented), a retaining roller 40 with spikes 41 or similar retaining means, and/or dragging wires 39 on a transverse bar 33. Since the precision of the drawing is not advantageous at this point, it is pointed out that the retaining means of the retaining plate, the retaining roller 40 or its spikes 41, and/or the dragging wires 39 of the transverse bar 33 in a particular example are only disposed in the areas of the conveyor discs 8, 8', 8" in order to promote the vertical alignment of the flakes. An arrangement of this type can help to reduce the total length of the roller sieve 5 if, in particular in the case of subsequent equipment installations in existing systems, there is little available space. Along with this, the described retaining means (retaining rollers) can be driven so that they rotate or can be entrained by the material stream 2 as in the case of an, in given cases, flexible retaining plate or the dragging wires. Preferably the retaining means, in particular the dragging wires 39 or the spikes 41 of the retaining rollers enter into the area of the conveyor discs 8, 8', 8" or are deflected by the material stream 2. Depending on the type of material it can however also be necessary to provide a necessary distance between the roller sieve 5 and the retaining means in order not to damage the flakes in the material stream 2. This is to be decided, based on operational considerations and depending on the material.

Figure 5:
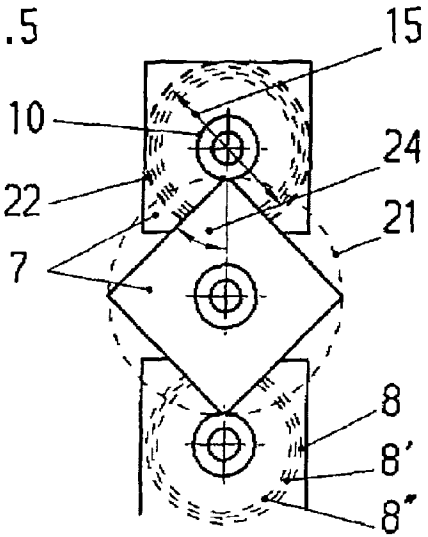
FIG. 5 shows a schematic top view and side view of an extract of two adjacent rollers with the impulse disc and different conveyor discs and their exemplary arrangement on a roller according to FIG. 2.

The clear distance 11 between the minor diameters 10 of the rollers 4 should preferably be 1.1 to 2 times the length of the flakes in order to sufficiently simplify the passing of the flakes through the slot area 6. However, even in this area, depending on the example, the distance 11 can be embodied to be increasing, in steps or continuously, in the transport direction 9. Conceivably there would be two or three areas in which the distance 11 in the transport direction is implemented to be increasingly greater in order to simplify the passing through of the material stream 2. The axles 12 of the rollers 4 preferably lie on a plane 13 (FIG. 5). In order to further promote the shaking and the passing of the material stream 2 through the roller sieve 5, the axles 12 can be disposed alternating or in groups on at least two planes 13, 13'. By the size of the slot area 6 or the slot width 14 the size of the foreign bodies 1, or lumps of adhesive, to be held back is defined. While flakes with a flat geometry but a thickness of only a few millimeters can pass through the slot area 6 without a problem, lumps of adhesive with a size over the slot width are sorted out and transported as rapidly as possible in the transport direction 9 to the collecting pan 38 at the end of the roller sieve 5. Preferably, the slot width 14 for OSB production is 10 to 20 mm, preferably 15 mm. In this connection a minor diameter 10 of the rollers 4 from 40 mm to 100 mm has proven itself, where the conveyor discs 8 and/or the impulse discs 7 should have a thickness of 2 to 7 mm.

Depending on the type of material stream 2 and arrangement of the device 3 in the apparatus it can be necessary to dispose at least one disintegrating roller 16 above the roller sieve 5. Preferably, the disintegrating rollers 16 are formed as spiked rollers. In order to ensure a uniform feed of the material stream 2 over the width 34 of the roller sieve 5 it is possible to dispose a dosing hopper (not represented in detail) with a discharge width corresponding to the discharge width 34 of the roller sieve 5 or, for example, a blower chute 23 for widening the material stream 2 to the width 34 of the roller sieve 5. In the present example a collecting belt 18 for the material stream 2 passing through the roller sieve 5 can be disposed below the roller sieve 5, or other collecting means or transport devices for the material stream 2 can be disposed, in order to convey it into apparatus parts leading further.

Figure 7:
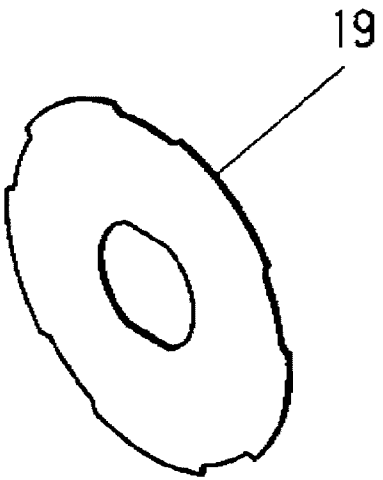
FIG. 7 shows a perspective view of the conveyor disc according to FIG. 6.
Figure 6:
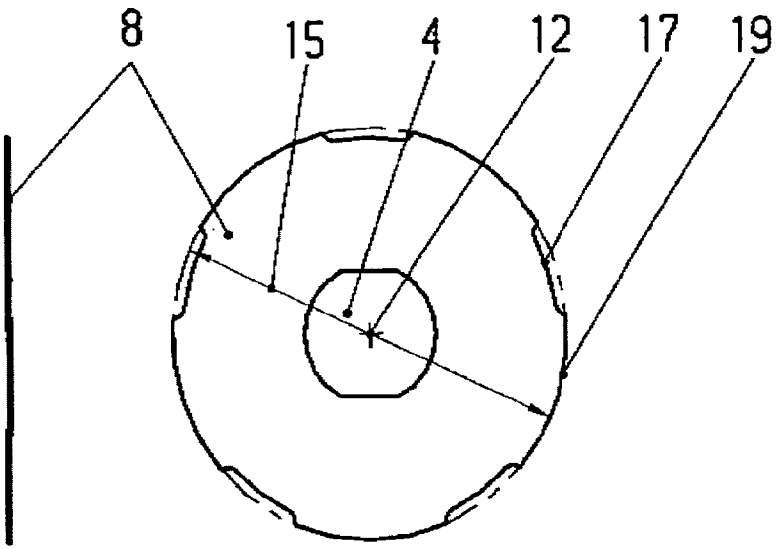
FIG. 6 shows a representation of a conveyor disc and its circumferential contour in side view and top view.
Figure 8:
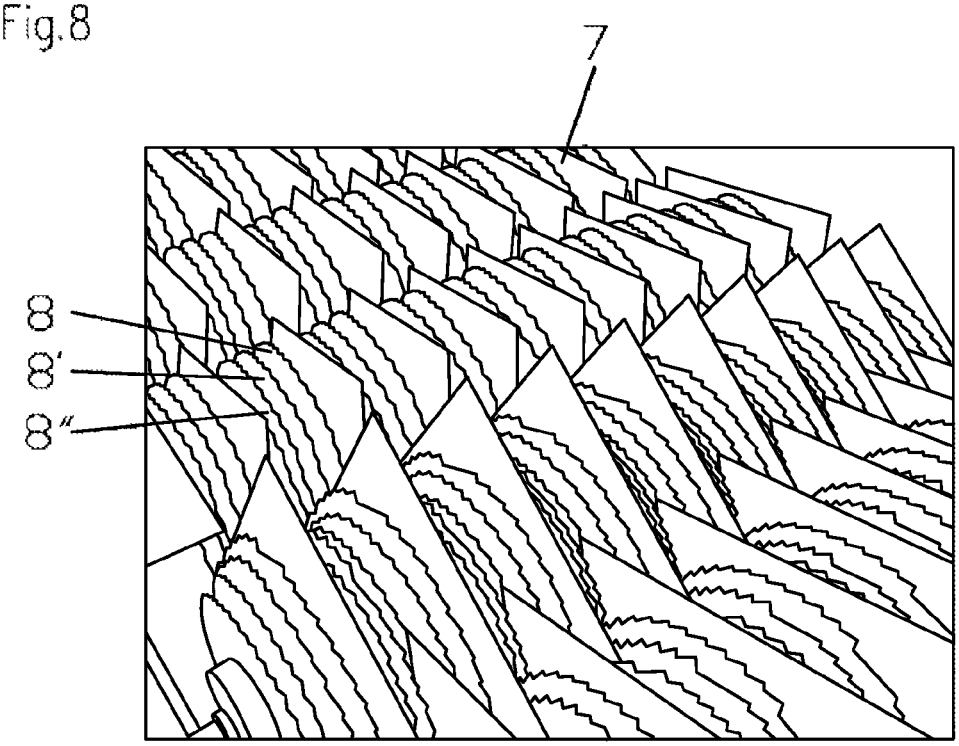
FIG. 8 shows a photographic image of an extract of a roller disc with three adjacent rollers according to FIG. 2.

In FIGS. 6 to 8 it can be seen that the conveyor discs 8 have a circumferential contour 19 which promotes friction. This circumferential (or peripheral) contour can be formed to have a shape similar to saw teeth (FIG. 8) or can also be reflected only in indentations 17. It is common for the circumferential contour 19 that it does not serve to apply impulses to the material stream 2 lying on the roller sieve 5 but rather serves to convey inclined parts of the material stream 2 through the slot area 6 or in the transport direction 9. In order to achieve this effect a smooth circumferential surface 19 is indeed possible but a broken circumferential (or peripheral) contour 19 with indentations 17 is better suited.

In contradistinction to this, the circumferential contour 20 of the impulse discs 7 must be suited to introducing its striking or hitting impulses into the material stream 2 lying on the roller sieve 5 in order to align parts or flakes of the material stream 2 in two planes so that they can fall with their smallest dimension, their thickness, through the slot area 6, where the longitudinal and horizontal extension of the flakes is aligned so as to be approximately parallel to the plane of the conveyor discs 8 or the impulse discs 7. In connection with this, the circumferential or peripheral contour 20 of the impulse discs is preferably formed to have three, four, five, or more corners. It is advantageous if the impulse disc 7 reaches approximately to the minor diameter 10 of the next roller 4. This serves less to define the slot area 6 than for optimal generation of impulses to the material stream 2 lying on the roller sieve 5. For this purpose it is advantageous if the diameter 15 of the largest conveyor disc 8 is less than or equal to the inner diameter 22 of the impulse disc 7. It is reasonable that the outer diameter 21 of the impulse disc 7 is greater than the diameter 15 of the conveyor disc 8 but limited by the clear distance 11 between the minor diameters 10 of the rollers 4. Furthermore, it has proven itself advantageous if the corners of an angular impulse disc 7 are implemented to be rounded or flattened in order to avoid unnecessary damage to the flakes.

In a particularly preferred example of the device 3, the conveyor discs 8 and the impulse discs 7 are disposed on two adjacent rollers 4 in such a manner relative to one to another that one impulse disc 7 of a roller 4 is disposed opposite to the smallest disposed conveyor disc 8" of the adjacent roller 4. In order to obtain the result that the generation of impulses into the material stream 2 is optimal and as constant over time as possible, the rollers 4 of the roller sieve 5 should be disposed turned, alternately, by an angle, preferably of 45°, relative to the angular position 24 of the impulse discs 7.

As has already been mentioned, the material stream 2 should be adapted in its width to the width 34 of the roller sieve 5 before striking the roller sieve 5. This is preferable when there is little available space and the roller sieve 5 can be implemented to be so much the shorter. Preferably, the rollers of the roller sieve 5 will be divided into at least two sections which are driven at the same, or a different, rotary speed, where the angular relationship of the impulse discs 7 (FIG. 5) to one another is prescribed. This can be made possible via electronically controlled electric motors for each roller or via forced guidance of the chain. Preferably, the rollers 4 of the roller sieve 5 rotate at 40 to 60 rpm. The material stream 2 can be disaggregated before striking the roller sieve 5 by means of disintegrating rollers 16. In so doing, the disintegrating rollers 16 can rotate at 40 to 250 rpm. Depending of the type of material stream 2 it can be reasonable that at least one roller 4 of the roller sieve 5 rotates in the sense opposite to that of the adjacent rollers 4.

Alternative preferred embodiments are set out below. According to alternative embodiment one, a device for sieving foreign bodies (1) out of a material stream (2) consisting of long, slender flakes with already applied adhesive in the course of the production of oriented strand boards, where the device (3) comprises a roller sieve (5) comprising several rollers (4) disposed in parallel to one another and, on the rollers (4) and perpendicular to their axial extension, discs are disposed which engage completely or partly meshing with the discs of the adjacent rollers (4) and thus form a slot area (6) between the rollers (4) and the discs, is characterized by the fact that on each roller (4) there are disposed, with a predefined spacing, impulse discs (7) for disaggregating the material stream (2) on the roller sieve (5) and conveyor discs (8) for conveying the material stream (2) in the transport direction (9) and through the slot area (6).

According to alternative embodiment two, a device according to alternative embodiment one is characterized by the fact that the impulse discs (7) are disposed in the roller sieve (5) in such a manner that only one impulse disc (7) per slot area (6) is disposed at the boundaries. According to alternative embodiment three, a device according to alternative embodiments one or two is characterized by the fact that on one roller (4) at least three conveyor discs (8) are disposed between two impulse discs (7). According to alternative embodiment four, a device according to any of alternative embodiments one through three is characterized by the fact that on a roller (4) adjacent conveyor discs (8) have different diameters. According to alternative embodiment five, a device according to any of alternative embodiments one through four is characterized by the fact that the clear distance (11) between the minor diameters (10) of the rollers (4) in the roller sieve (5) is 1.1 to 2 times the length of the flakes.

According to alternative embodiment six, a device according to any of alternative embodiments one through five is characterized by the fact that the clear distance (11) between the minor diameters (10) of the rollers (4) in the roller sieve (5) increases in the transport direction (9), in steps or continuously, from 1.1 to 2 times the length of the flakes. According to alternative embodiment seven, a device according to any of alternative embodiments one through six is characterized by the fact that the axles (12) of the rollers (4) are disposed either on one plane (13) or alternating on at least two planes (13, 13'). According to alternative embodiment eight, a device according to any of alternative embodiments one through seven is characterized by the fact that the width (14) of the slot (6) is 10 to 15 mm. According to alternative embodiment nine, a device according to any of alternative embodiments one through eight is characterized by the fact that the minor diameter (10) of the rollers (4) is 40 mm to 100 mm. According to alternative embodiment ten, a device according to any of alternative embodiments one through nine is characterized by the fact that the conveyor discs (8) and/or the impulse discs (7) have a thickness of 2 to 7 mm.

According to alternative embodiment eleven, a device according to any of alternative embodiments one through ten is characterized by the fact that above the roller sieve (5) there is disposed at least one disintegrating roller (18) for the material stream (2), where the disintegrating rollers (18) can be formed as spiked rollers. According to alternative embodiment twelve, a device according to any of alternative embodiments one through eleven is characterized by the fact that above the roller sieve (5) there is disposed a dosing hopper for uniform feeding of the roller sieve (5) with the material stream (2). According to alternative embodiment thirteen, a device according to any of alternative embodiments one through twelve is characterized by the fact that above the roller sieve (5) there is disposed a collecting belt (18) for the material stream (2) passing through the roller sieve (5). According to alternative embodiment fourteen, a device according to any of alternative embodiments one through thirteen is characterized by the fact that the conveyor discs (8) have a circumferential contour (19) which promotes friction. According to alternative embodiment fifteen, a device according to any of alternative embodiments one through fourteen is characterized by the fact that the peripheral contour (19) of the conveyor discs (8) is formed to have a shape similar to saw teeth.

According to alternative embodiment sixteen, a device according to any of alternative embodiments one through fifteen is characterized by the fact that the peripheral contour (20) of the impulse discs (7) is formed to have three, four, five, or six corners. According to alternative embodiment seventeen, a device according to any of alternative embodiments one through sixteen is characterized by the fact that the impulse disc (7) reaches approximately to the minor diameter (10) of the next roller (4). According to alternative embodiment eighteen, a device according to any of alternative embodiments one through seventeen is characterized by the fact that the diameter (15) of the largest conveyor disc (8) is less than or equal to the inner diameter (22) of the impulse disc (7). According to alternative embodiment nineteen, a device according to any of alternative embodiments one through eighteen is characterized by the fact that on two adjacent rollers (4) the conveyor discs (8) and the impulse discs (7) are disposed in such a manner relative to one to another that one impulse disc (7) of a roller (4) is disposed opposite to the smallest disposed conveyor disc (8) of the adjacent roller (4). According to alternative embodiment twenty, a device according to any of alternative embodiments one through nineteen is characterized by the fact that above the roller sieve (5) there is disposed a blower chute (23) for widening the material stream (4) to the width (34) of the roller sieve (5).

According to alternative embodiment twenty-one, a device according to any of alternative embodiments one through twenty is characterized by the fact that alternately the rollers (4) of the roller sieve (5) are disposed turned by 45° relative to the angular position (24) of the impulse discs (7). According to alternative embodiment twenty-two, a device according to any of alternative embodiments one through twenty-one is characterized by the fact that above the roller sieve (5) retaining means are disposed, such as at least one retaining plate, a retaining roller (40) with spikes (41), and/or dragging wires (39) on a transverse bar (33). According to alternative embodiment twenty-three, a device according to any of alternative embodiments one through twenty-two is characterized by the fact that the retaining means of the retaining plate, a retaining roller (40) or its spikes (41), and/or dragging wires (39) on a transverse bar (33) are disposed only in the areas of the conveyor discs (8, 8', 8").

According to alternative embodiment twenty-four, a system for the production of composite boards and comprising in series at least a drying device (25), an adhesive-applying device (26), a flake hopper (27) with a feeder device (28), and a spreading device (29) with a spreading head (30) for a material stream (2) consisting of long, slender flakes for forming a mat (31) on a forming belt (32) in front of a press (36) is characterized by the fact that after the adhesive-applying device (26) there is disposed a device (3) for sieving foreign bodies out of a material stream (2) consisting of flakes to which adhesive has been applied.

According to alternative embodiment twenty-five, a system according to alternative embodiment twenty-four is characterized by the fact that the device (3) is disposed before or after the feed device (28) for the flake hopper (27). According to alternative embodiment twenty-six, a system according to alternative embodiments twenty-four or twenty-five is characterized by the fact that as the feed device (4) for the flake hopper (4) a slewing screw conveyor (30) is disposed and after the slewing screw conveyor (30) the roller sieve (5) is disposed so as to slew with the slewing screw conveyor. According to alternative embodiment twenty-seven, a system according to any of alternative embodiments twenty-four through twenty-six is characterized by the fact that the device (3) is disposed between the flake hopper (27) and spreading device (28) with a spreading head (30).

According to alternative embodiment twenty-eight, a process for sieving foreign bodies (4) out of a material stream (4) consisting of long, slender flakes in the course of the production of oriented strand boards, where the material stream (4) is discharged on one side of a roller sieve (5) comprising several rollers (4) disposed in parallel to one another and where, on the rollers (4) and perpendicular to their axial extension, discs are disposed which engage completely or partly meshing with the discs of other rollers (4) is characterized by the fact that the flakes of the material stream (5) are conveyed by the conveyor discs (8) and are aligned by the partially disposed, larger impulse discs (7) in two planes so that they can fall with their smallest dimension, their thickness, through the slot area (6), where the longitudinal and horizontal extension of the flakes is aligned so as to be approximately parallel to the plane of the conveyor discs (8) or impulse discs (7) and where foreign bodies (1) are conveyed up to the end of the roller sieve (5) and thus are separated out of the production process.

According to alternative embodiment twenty-nine, a process according to alternative embodiment twenty-eight is characterized by the fact that foreign bodies (1), such as lumps of adhesive or oversize flakes, with not even one dimension (length, width, thickness) under 15 mm are separated out. According to alternative embodiment thirty, a process according to alternative embodiments twenty-eight or twenty-nine is characterized by the fact that the material stream (2), before striking the roller sieve (5), is adapted in its width to the width (34) of the roller sieve (5). According to alternative embodiment thirty-one, a process according to any of alternative embodiments twenty-eight through thirty is characterized by the fact that the rollers (4) of the roller sieve (5) are operated alternately turned by 45° relative to the angular position (24) of the impulse discs (7). According to alternative embodiment thirty-two, a process according to any of alternative embodiments twenty-eight through thirty-one is characterized by the fact that the rollers (4) of the roller sieve (5) rotate at 40 to 60 rpm. According to alternative embodiment thirty-three, a process according to any of alternative embodiments twenty-eight through thirty-two is characterized by the fact that the rollers (4) of the roller sieve (5) are operated, in at least two sections, at different rotary speeds.

According to alternative embodiment thirty-four, a process according to any of alternative embodiments twenty-eight through thirty-three is characterized by the fact that the material stream (2) is disaggregated, before striking the roller sieve, by means of disintegrating rollers (16). According to alternative embodiment thirty-five, a process according to any of alternative embodiments twenty-eight through thirty-four is characterized by the fact that the disintegrating rollers (16) rotate at 40 to 250 rpm. According to alternative embodiment thirty-six, a process according to any of alternative embodiments twenty-eight through thirty-five is characterized by the fact that at least one roller (4) of the roller sieve (5) rotates in the sense opposite to that of the adjacent rollers (4). According to alternative embodiment thirty-seven, a process according to any of alternative embodiments twenty-eight through thirty-six is characterized by the fact that the flakes of the material stream (2), with the aid of the retaining means above the roller sieve (5), are aligned more strongly in such a manner that they pass through the roller sieve (5) more rapidly and more gently. According to alternative embodiment thirty-eight, a process according to any of alternative embodiments twenty-eight through thirty-seven is characterized by the fact that the flakes are aligned more strongly with the aid of retaining means, such as a retaining plate, a retaining roller (40), and/or dragging wires (39) only in the areas of the conveyor discs (8, 8', 8").

Additional advantages and modifications will occur to those skilled in the art. Therefore, although the inventive concept has been described and illustrated with reference to preferred embodiments, various modifications may be made without departing from the spirit or scope of the general inventive concept as defined by the appended claims and their equivalents.

What is claimed is:

1. A device for sieving foreign bodies out of a material stream, comprising:

a roller sieve comprising a plurality of rollers disposed in parallel to one another; and discs disposed on the plurality of rollers such that they are perpendicular to the axial extension of the rollers, wherein the discs of adjacent rollers are engaged so as form slot areas between the discs and the adjacent rollers through which a first portion of the material stream can flow, wherein the discs disposed on each roller comprise impulse discs having a peripheral contour comprised of at least one corner, the peripheral contour of the impulse discs configured to disaggregate a material stream disposed on the roller sieve, and conveyor discs having a peripheral contour comprised of a series of indentations, the conveyor discs configured to promote friction to convey a second portion of the material stream in a transport direction, and wherein the conveyor discs disposed on each roller have varying diameters.

2. The device of claim 1, wherein the impulse discs are disposed on the plurality of rollers in such a manner that boundaries of each slot area include only one impulse disc.

3. The device of claim 1, wherein each roller includes at least three conveyor discs disposed between two impulse discs.

4. The device of claim 1, wherein adjacent conveyor discs have different diameters.

5. The device of claim 1, wherein the first portion of the material stream comprises flakes, and wherein a distance between adjacent rollers in the roller sieve is about 1.1 to 2 times a length of the flakes in the material stream.

6. The device of claim 1, wherein a distance between adjacent rollers in the roller sieve increases along the transport direction of the roller sieve.

7. The device of claim 1, wherein axles of the plurality of rollers are disposed on one plane or are disposed in an alternating manner on at least two planes.

8. The device of claim 1, wherein a width of each slot area is 10 to 15 mm.

9. The device of claim 1, wherein a distance between adjacent rollers is from 40 mm to 100 mm.

10. The device of claim 1, wherein the conveyor discs and the impulse discs have a thickness of 2 to 7 mm.

11. The device of claim 1, further comprising at least one disintegrating roller disposed above the roller sieve, wherein each disintegrating roller is a spiked roller.

12. The device of claim 1, further comprising a dosing hopper disposed above the roller sieve.

13. The device of claim 1, further comprising a collecting belt disposed below the roller sieve.

14. The device of claim 1, wherein the peripheral contour of the conveyor discs is a circumferential contour.

15. The device of claim 1, wherein the series of indentations comprising the peripheral contour of the conveyor discs forms a saw-tooth peripheral contour.

16. The device of claim 1, wherein the peripheral contour of the impulse discs comprises three, four, five, or six corners.

17. The device of claim 1, wherein each impulse disc is disposed on each roller so that a periphery of each impulse disc reaches an adjacent roller.

18. The device of claim 1, wherein, for each roller, a diameter of the largest conveyor disc is less than or equal to an inner diameter of the impulse discs.

19. The device of claim 1, and wherein on two adjacent rollers, the conveyor discs and the impulse discs are disposed in such a manner relative one to another that each impulse disc of a first roller is disposed opposite to a smallest disposed conveyor disc of a second adjacent roller.

20. The device of claim 1, further comprising a blower chute disposed above the roller sieve, wherein the blower chute is configured to widen the material stream to a width of the roller sieve.

21. A device for sieving foreign bodies out of a material stream, comprising:

a roller sieve comprising a plurality of rollers disposed in parallel to one another; and discs disposed on the plurality of rollers such that they are perpendicular to the axial extension of the rollers, wherein the discs of adjacent rollers are engaged so as form slot areas between the discs and the adjacent rollers through which a first portion of the material stream can flow, wherein the discs disposed on each roller comprise impulse discs configured to disaggregate a material stream disposed on the roller sieve and conveyor discs configured to convey a second portion of the material stream in a transport direction wherein the conveyor discs disposed on each roller have varying diameters, and wherein an impulse disc on a roller of the roller sieve is disposed at a 45° angle relative to an angular position of an impulse disc on an adjacent roller of the roller sieve.

22. The device of claim 1, further comprising above the roller sieve a retainer, wherein the retainer is at least one of a retaining plate, a retaining roller with spikes, and dragging wires on a transverse bar.

23. The device of claim 22, wherein the spikes or the dragging wires of the retainer are only disposed above the conveyor discs of the roller sieve.

* * * * *